United States Patent [19]

Sciongay, Sr. et al.

[11] 4,217,670

[45] Aug. 19, 1980

[54] FOLDABLE RAIL ASSEMBLY

[75] Inventors: Edward S. Sciongay, Sr.; Edward S. Sciongay, Jr., both of Monroe, Conn.

[73] Assignee: The Shelton Manufacturing Co., Shelton, Conn.

[21] Appl. No.: 10,107

[22] Filed: Feb. 7, 1979

[51] Int. Cl.[2] ..... A47D 7/02; A47C 21/00

[52] U.S. Cl. ..... 5/425; 5/430

[58] Field of Search ..... 5/425, 428–430; 256/59, 65; 297/417

[56] References Cited

U.S. PATENT DOCUMENTS

| | | | |
|---|---|---|---|
| 2,587,291 | 2/1952 | Des Rochers | 5/430 |
| 3,526,008 | 9/1970 | Pruim | 5/430 |
| 4,084,277 | 4/1978 | Conrad et al. | 5/430 |

*Primary Examiner*—Casmir A. Nunberg

*Attorney, Agent, or Firm*—Thomas L. Tully

[57] ABSTRACT

A guard rail assembly adapted to be attached to a bed, table or other element and to be adjusted in simple manner, when so attached, between upright and locked position in which it provides a vertical barrier or support extending above the horizontal surface or plane of the bed, table or other element, and folded position in which it is pivoted to or below the horizontal surface plane of said element to occupy a minimum of space and present no horizontal obstruction to said surface. The present invention is characterized by a guard rail assembly which is sturdy, which contains a minimum number of moving parts and which is adjustable between upright, locked position and folded position with a minimum amount of effort which may be exerted by means of one hand in a single continuous motion.

4 Claims, 3 Drawing Figures

FOLDABLE RAIL ASSEMBLY

BACKGROUND OF THE INVENTION

Figure 1:
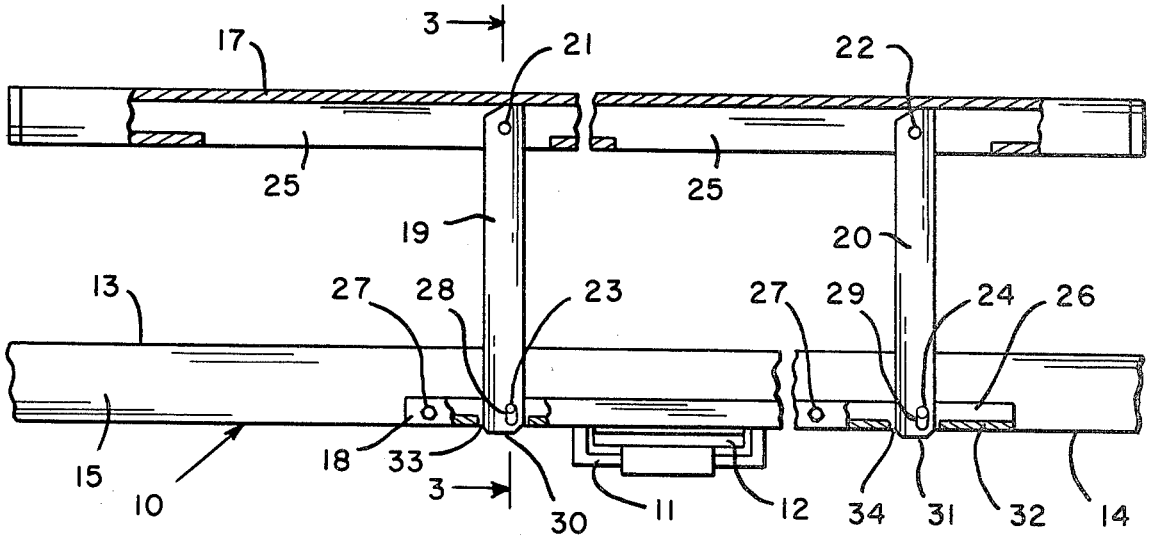

A wide variety of foldable, rectractable, collapsible and pivotable guard rails, side rails, hand rails and similar barriers have been proposed for a variety of uses, each use having different considerations and requirements.

The present guard rail assemblies are particularly designed for use on medical examination tables, such as X-ray tables where unobstructed access to the table top and to the X-ray film cassette compartment beneath the table is essential, and where a guard rail is also essential to prevent a patient from falling from the table top during voluntary movement from one examination position to another or during any involuntary movement which may accompany an injury, such as due to delerium or due to regaining consciousness, etc.

Reference is made to U.S. Pat. Nos. 3,997,792 and 4,084,277 which relate to collapsible guard rail assemblies for X-ray tables. The rail assemblies of said Patents are in current use but have certain disadvantages. Firstly, they are difficult to move from raised position to lowered position because the two retaining means which lock the assembly in raised position, i.e., the locking sleeves must be individually manually raised above the mounting means before the assembly can be pivoted to lowered position. This requires the use of both hands whereas single hand operation is desirable to leave the other hand free to stabilize the patient. Also the hands can be injured if they are caught between the assembly and the edge of the table as the assembly is moved to lowered position.

Another disadvantage arises from the use of the retainer sleeves and springs which require assembly and which can wear and break as a result of the frictional contact between the sleeves and the upright supports and the compression of the springs during repeated use.

Another disadvantage arises from the spaced mounting members which must be precisely spaced when attached to the side of the table, or else the assembly will not move properly between raised and lowered position.

A variety of different locking means have been proposed for guard rails of all types but such always require the use of two hands, i.e., one hand to release the lock and the other hand to pivot the guard rail to lowered position. Reference is made to U.S. Pat. Nos. 3,840,917 and 3,930,273 which employ a locking lever, and U.S. Pat. Nos. 2,972,153 which broadly teaches a number of locking means. In each of these cases there is no suggestion of a locking means which enables the operator to unlock the raised assembly and move it to lowered position with one hand in a single operation, and the locking means disclosed involve additional moving parts which add to the expense of the assembly and which represent projections which obstruct the free access to the underside of the table and/or detract from the simple appearance of the assembly, particularly when the assembly is in lowered, folded position.

SUMMARY OF THE INVENTION

The present invention relates to an adjustable guard rail assembly which is simple in design, operation and appearance whereby it seemingly disappears when in lowered, folded position, can be raised and lowered through locking position with a single hand and in a single operation, and is simple to attach to any mounting surface such as a table edge, bed frame, stairway or other support-requiring element.

The novel guard rail assemblies of the present invention, according to the preferred embodiment thereof, comprise a hollow, tubular top rail, an open channel bottom mounting rail, support bars pivotably connected within both said top and bottom rails, the connection of each said support bar to said bottom rail being such as to permit each said bar, when at an angle perpendicular to said bottom rail, to be moved between lift position, in which said bar can be pivoted relative to said bottom rail, and rest position, in which the lower end or base of each said rail is engaged by a retaining means such as an opening in the base of said bottom rail to prevent relative pivotal movement between each said support bar and said bottom rail. Thus the present guard rail assemblies can be moved from upright, locked position to folded position by simply grasping the mid-point of the top rail with one hand, lifting the top rail a slight distance to raise the base of the support bars out of engagement with the openings in the base of the bottom rail and pivoting the top rail in a clockwise direction until the underside of the top rail rests on the topside of the bottom rail to conceal the support bars therewithin.

Figure 2:
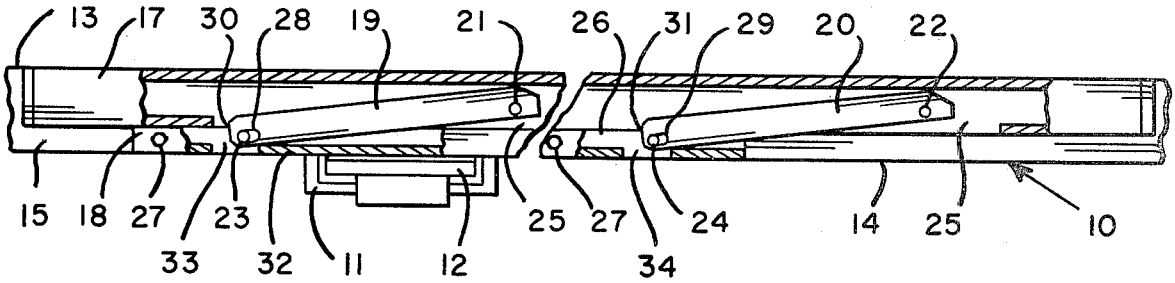
Figure 3:
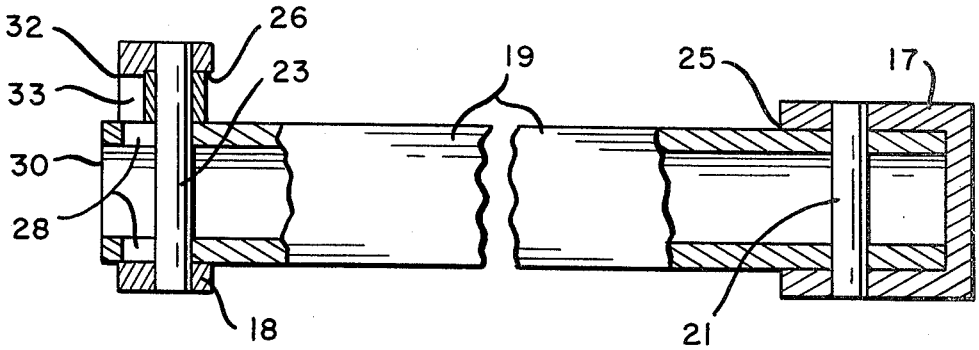

Reference is made to the accompanying drawing in which:

FIG. 1 is a side elevational view of a guard rail assembly according to a preferred embodiment of the present invention, the assembly being illustrated mounted in upright, locked position on the side of an X-ray table and portions of the top and bottom rails being cut away for purposes of illustrations;

FIG. 2 corresponds to FIG. 1 but illustrates the guard rail assembly in folded position within the confines of the edge of the table top, and FIG. 3 is an enlarged segmented view representative of each of the upright, locked support bars of FIG. 1 and taken along the line 3—3 thereof.

Referring to the drawing, the X-ray table 10 thereof is of the type disclosed in greater detail in U.S. Pat. No. 3,997,792, discussed supra, being adjustable between horizontal position, as illustrated herein, and vertical or stand-up position, and including a compartment 11 supported beneath the table top and adapted to receive and hold an X-ray film cassette 12 beneath the X-ray-permeable table top supporting the person being examined, the table top being adjustable along a vertical path, relative to the compartment 11, to permit movement of the person supported on the table top relative to the X-ray camera.

The X-ray table 10 generally comprises a rectangular support having a thickness of from about 2 to 5 inches having a padded top surface 13, and undersurface 14 and side walls 15. Each side wall 15 provides a mounting surface for one of the guard rail assemblies of the present invention which generally are used in pairs. However, a fixed guard rail may be used on one side, if desired, since access to the table top from one side may be sufficient for certain installations.

The present guard rail assembly 16 comprises a hollow, square-tubular, elongate top rail 17, preferably having plastic or metallic end caps, as illustrated, a wider rectangular channel bottom or mounting rail 18 and hollow, square-tubular support bars 19 and 20 which are pivotably attached within the top rail 17 by means of hardened, press-fitted pins 21 and 22 and within the wider bottom rail 18 by means of similar pins 23 and 24, spacers being used to position the support bars rearwardly within rail 18. The undersurface of the top rail 17 is open, at least partially, and the upper surface of the bottom rail is open, to provide recesses 25 and 26 respectively, into which portions of the more narrow support bars 19 and 20 can be received when the assembly is moved to lowered or folded position shown by FIG. 2.

The lower or mounting rail 18 is attached adjacent the lower edge of the side 15 of table 10 by means of mounting screws or bolts 27 which firmly secure the assembly to the table 10 in such position that both the top and bottom rails are flush with or within the confines of the edge 15 of the table 10 when the assembly is in lowered or folded position, shown by FIG. 2. In the embodiment illustrated, the square-tubular top rail is 48 inches long and has sides of about one inch, the channel or open tubular bottom rail is 34 inches long and has sides of about ½ inch and a width of about 1¼ inch, and the edge 15 of table 10 has a thickness of about 2 inches.

The most critical feature of the structure of the present guard rail assemblies is the means for attaching and locking the support bars 19 and 20 to the bottom rail 18. Thus the support bars 19 and 20 are provided with longitudinal elongated holes or slots 28 and 29 which are closely spaced from the lower ends or bases 30 and 31 of the support bars and which receive the attachment pivot pins 23 and 24 in such a manner to permit perpendicular movement of the upright or vertical support bars 19 and 20 relative to the pivot pins 23 and 24 fixed to the horizontal mounting rail 18, the extent of such movement being limited by the length of the slots 28 and 29. The position of the slots 28 and 29 relative to the bases 30 and 31 of support bars 19 and 20 and the location of the pivot pins 23 and 24 relative to the underside or floor 32 of the bottom rail 18 is such that the bases 30 and 31 project like slide bolts into retaining means comprising openings 33 and 34 in floor 32 when the assembly is in upright position with the upper ends of the vertical slots 28 and 29 of the upright support bars 19 and 20 resting on the upper surface of pivot pins 23 and 24, as illustrated most clearly by FIG. 3 of the drawing. Openings 33 and 34 are just slightly larger than the width of the ends 30 and 31 of support bars 19 and 20 so that said ends can be received therein with ease to rest the supported top rail into locked position. In such position the lower ends of support bars 19 and 20 are engaged by both the pivot pins 23 and 24 and the floor 32 of lower rail 18 to prevent pivotal motion of said support bars about said pivot pins 23 and 24 until the top rail 17 is lifted slightly to withdraw support bar ends 30 and 31 from floor openings 33 and 34, causing the lower end of slots 28 and 29 to engage the underside of pins 23 and 24, whereby the support bars 19 and 20 and top rail 17 can be pivoted clockwise until the top and bottom rails contact each other in the lowered or folded position shown by FIG. 2. In such position the support bars 19 and 20 are completely contained and concealed, partly within top rail 17 and partly within bottom rail 18, movement within said rails being permitted by openings 25 and 26 therein.

As illustrated by FIG. 1, the upper ends of support bars 19 and 20 are provided with cuts or tapers 35 and 36 on the left side and are uncut on the right side to provide stop elements 37 and 38 respectively, which limit the counter-clockwise movement of the top rail 17 when the assembly is moved from folded to upright position. When such stop elements 35 and 36 engage the inside roof of the top rail 17, the support bars 19 and 20 and their slots 28 and 29 are vertical and the bases 30 and 31 of the support bars are aligned with and will fall into retainer openings 33 and 34 to lock the assembly in upright position. Conversely, the tapered upper edges of support bars 19 and 20 permit the bars to pivot freely in the clockwise direction when the top rail is lifted to disengage the ends of bars 19 and 20 for movement of the assembly to the lowered or folded position.

While the preferred assembly of the present invention is produced from lightweight aluminum or alloy stock in hollow, flat-tubular and channel form, as illustrated, it will be clear to those skilled in the art that the top and/or bottom rails and/or the support bars 19 and 20 may be cylindrical, if desired, and that the support bars may be solid, if desired. Moreover, while the use of a hollow tubular top rail and a channel bottom rail is preferred in order to provide an assembly which hides and shields the support bars in folded position, thereby being less conspicuous and free of projections which can catch on clothing or cause injury, it will be obvious that for certain uses, such as a folding handrail for a stairway, that neither the top nor bottom rail need be hollow or tubular or channel provided that both rails are pivotally connected to the support bars and the bottom rail contains means extending therefrom for receiving the ends of the support bars in locked position. Such means may consist of a pin, similar to pivot pins 23 and 24, one each extending parallel to and below pins 23 and 24 respectively and adapted to engage a slot or recess cut into the bottom 30 and 31 of the support bars. Alternatively the bottom rail may be tubular or may be an angle rail with openings similar to openings 33 and 34 of the drawing provided in the bottom extension to provide locking means of the support bars.

Variations and modifications will be apparent to those skilled in the art within the scope of the present claims.

We claim:

1. A foldable rail assembly adapted to be attached to the edge of an element having a horizontal surface and adapted to be adjusted vertically between upright position in which it extends above said surface to provide a vertical barrier for said surface, and folded position in which it occupies a minimum of space at said edge and generally at or below the plane of said horizontal surface, said assembly comprising a mounting rail adapted to be attached to the edge of an element below the horizontal surface thereof, a top rail parallel to said mounting rail, support bars pivotably connected to said mounting rail and to said top rail in spaced, parallel position to permit said top rail to be pivoted between upright position in which it is spaced above said mounting rail and folded position in which it is in contact with said mounting rail, said mounting rail comprising a channel member which is open on the top side thereof and within which the support bars are pivotably attached and within which portions of the support bars are received when said assembly is pivoted to folded position, each of said support bars being pivotably attached to said mounting rail by means of a vertical pin on said rail which is engaged within a longitudinal slot in said support bar spaced from the base thereof, to permit said support bars to be moved in a direction perpendicular to said mounting rail, when said assembly is in upright position, between resting position, in which the base of each said support bar engages a retaining means present on the mounting rail, below the point of pivotal attachment between said bar and said rail, to prevent pivotal movement of each said support bar, and lift position in which the base of each said support bar is free of engagement with the said retaining means and the assembly can be pivoted to folded position, said retaining means for each support bar comprising and opening on the bottom side or floor of the channel mounting rail adapted to receive the base of the support bar, when the support bar is in resting position, and to prevent pivotal movement of the support bar in said position.

2. A rail assembly according to claim 1 in which said top rail comprises a hollow tubular member having openings on the underside thereof within which the support bars are pivotably attached and within which portions of the support bars are received when said assembly is pivoted to folded position.

3. A rail assembly according to claim 2 in which said top rail is a hollow tubular member and said mounring rail is a channel member, said members having openings on the underside and topside thereof, respectively, within which the support bars are received and concealed when said assembly is pivoted to folded position.

4. A rail assembly according to claim 1 in which the top rail is provided with means which limit the pivotal movement of the assembly to one direction and which provide a stop element when the assembly is in upright position and the support bars are aligned with the reatiner means.

* * * * *